US012672751B2

(12) United States Patent
Koester et al.

(10) Patent No.: US 12,672,751 B2
(45) Date of Patent: Jul. 7, 2026

(54) MOP BUNDLE WITH AGITATION FEATURES

(71) Applicant: The Tuway American Group, Inc., Troy, MI (US)

(72) Inventors: Douglas Koester, Troy, MI (US); Nicholas Koester, Troy, MI (US)

(73) Assignee: The Tuway American Group, Inc., Troy, MI (US)

( * ) Notice: Subject to any disclaimer, the term of this patent is extended or adjusted under 35 U.S.C. 154(b) by 456 days.

(21) Appl. No.: 18/066,889

(22) Filed: Dec. 15, 2022

(65) Prior Publication Data

US 2023/0190069 A1 Jun. 22, 2023

Related U.S. Application Data

(60) Provisional application No. 63/337,266, filed on May 2, 2022, provisional application No. 63/291,331, filed on Dec. 17, 2021.

(51) Int. Cl.
*A47L 13/24* (2006.01)

(52) U.S. Cl.
CPC ..... *A47L 13/24* (2013.01)

(58) Field of Classification Search
CPC ..... A47L 13/24; A47L 13/252; A47L 13/255
USPC ..... 15/229.1, 229.6, 228, 115
See application file for complete search history.

(56) References Cited

U.S. PATENT DOCUMENTS 3,795,934 A * 3/1974 Moss ..... A47L 13/20 15/118
5,784,746 A * 7/1998 Williams ..... A47L 13/20 15/118
6,212,729 B1 * 4/2001 Weichelt ..... A47L 13/20 15/228

(Continued)

FOREIGN PATENT DOCUMENTS

CN 204394429 U * 6/2015 ..... A47L 13/16

OTHER PUBLICATIONS

PE2E Translation CN-204394429; A New-type Mop; Guo, D; Jun. 17, 2015 (Year: 2015).*

(Continued)

*Primary Examiner* — Brian D Keller
*Assistant Examiner* — Sidney D Full
(74) *Attorney, Agent, or Firm* — Young Basile Hanlon & MacFarlane, P.C.

(57) ABSTRACT

A mop strand bundle a plurality having elongated first elongated cleaning tendrils having a first surface roughness and oriented in parallel relationship to one another and connected to one another in at least one location. The mop strand bundle also includes at least one elongated second cleaning tendril and a head band. The second elongated cleaning tendril is oriented in parallel relationship to at least one opposed elongated edge and is in moveable relationship with at least one first cleaning tendril. The elongated second cleaning tendril has a second surface roughness greater than the first surface roughness. The headband is positioned in overlying fixed relationship to the plurality of elongated first cleaning strands and connected to the at least one elongated second cleaning tendril at a location between the first and second ends of the plurality of elongated first cleaning tendrils.

21 Claims, 9 Drawing Sheets

(56) References Cited

U.S. PATENT DOCUMENTS

| | | | | |
|---|---|---|---|---|
| 9,010,873 | B1 * | 4/2015 | Williams | A47L 13/20 15/229.1 |
| 10,820,775 | B1 * | 11/2020 | Gilbert | A47L 13/38 |
| 2010/0263153 | A1 * | 10/2010 | Patrick | D02G 3/36 15/209.1 |

OTHER PUBLICATIONS

Just Crafting Around website "What is Chinlon Fabric?"; https://justcraftingaround.com/chinlon-fabric/; Ty, Sara; Jun. 21, 2021 (Year: 2021).*

* cited by examiner

MOP BUNDLE WITH AGITATION FEATURES

CROSS-REFERENCE TO RELATED APPLICATIONS

The present application is a non-provisional application that claims priority to U.S. Provisional Application Ser. No. 63/291,331 filed Dec. 17, 2021 and U.S. Provisional Application Ser. No. 63/337,266 filed May 2, 2022, the specifications of which are incorporated by reference herein.

BACKGROUND

The present disclosure relates in general to wet mops which include, but are not limited, to cut-end or looped end mops.

Various mop configurations have been proposed for cleaning operations particularly wet mop cleaning operations. While various cleaning issues have been considered, it has been found that little or no attention has been provided to issues pertaining to enhancing the agitation and/or mechanical cleaning action and/or anti-microbial efficacy of mopping activity.

While various compounds and/or chemical agents have been proposed as additives for cleaning materials to be added to the aqueous cleaning solution to be employed, there has been little or no attention to the role of the mop head applicator in enhancing agitation and/or cleaning efficiency and/or antimicrobial action of the cleaning and mopping process.

The present invention relates in general to wet mops which include, but are not limited, to cut-end or looped end mops

SUMMARY OF THE INVENTION

Disclosed herein is a mop strand bundle that includes a plurality of elongated first cleaning tendrils, each first cleaning tendril having a first end and an opposed second end, the first cleaning tendrils oriented in relationship to one another and connected to one another in at least one location, each cleaning tendril having a first surface roughness.

The mop strand bundle also includes at least one elongated second cleaning tendril. The second cleaning tendril has a first end, a second end opposed to the first end and opposed elongated side surfaces, the at least one second cleaning tendril can be oriented in abutting moveable relationship with at least one first cleaning tendril and connected to the plurality of elongated first cleaning tendrils in at least one location, the wherein the at least one elongated second cleaning tendril having a second surface roughness with the second surface roughness being greater than the first surface roughness.

The mop strand bundle also includes a tendril connecting member that is configured to connect the plurality of first elongated cleaning tendrils and the at least one second elongated cleaning tendril such that the plurality of first elongated cleaning tendrils and at least one second elongated cleaning tendril are moveable relative to one another. In certain embodiments the tendril connecting member can be a head band. Where desired or required, the headband can be positioned in overlying fixed relationship to the plurality of elongated first cleaning strands and connected to the at least one elongated second cleaning tendril at a location between the first and second ends of the plurality of elongated first cleaning tendrils.

Also disclosed herein is a mop device that includes a handle, a mop head configured to connect to the handle, and the aforementioned mop strand bundle connected to the mop head.

Also disclosed herein is a method for cleaning a floor comprising the steps of contacting the floor with a mop strand bundle having a plurality of first elongated cleaning tendrils having a first surface roughness, at least one second elongated cleaning tendril having a second surface roughness greater than the first surface roughness and a tendril connecting member configured to connect to the plurality of elongated first cleaning tendrils and to the at least one second elongated cleaning tendril such that the plurality of first elongated cleaning tendrils and at least one second elongated cleaning tendril are moveable relative to one another; and moving the mop in one or more movement patterns over the floor surface.

BRIEF DESCRIPTION OF DRAWINGS

The various features, advantages and other uses of the present apparatus will become more apparent by referring to the following detailed description and drawing in which.

DETAILED DESCRIPTION

Figure 1:
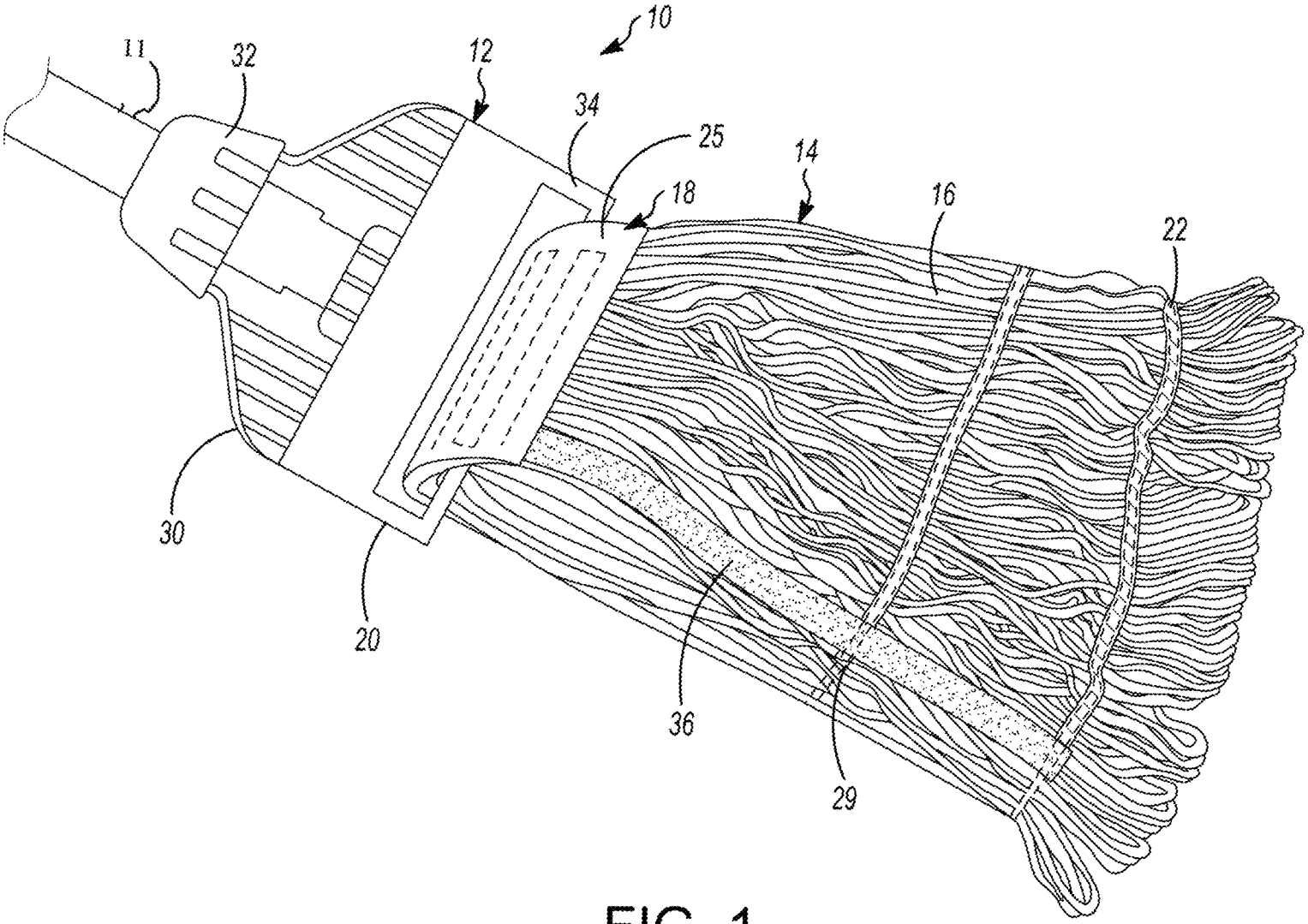
FIG. 1 is a detail perspective view of a general embodiment of a mop device as disclosed herein.

The present disclosure is predicated on the unexpected discovery that mop strand bundle and mop head design disclosed herein can have efficacious effect in reducing microbial load present on associated surfaces and/or cleaning efficiency. The present disclosure is also predicated on the unexpected discovery that the mop bundle as disclosed herein can be employed to remove dirt and grime adhering to various floor surface areas with increased efficiency over conventional mop bundles.

The mop device disclosed herein broadly includes a handle, a mop head configured to connect to the handle and a mop strand bundle composed of a plurality of elongated first elongated cleaning tendrils such as first strand members that are disposed in abutting side-by-side and/or parallel relation to one another. The first elongated cleaning tendrils can be positioned relative to one another such that the various individual elongated cleaning tendrils have limited movement relative to one another.

The mop strand bundle as disclosed herein includes a plurality of first elongated cleaning tendrils. Each first elongated cleaning tendril has a first end and an opposed second end. The first elongated cleaning tendrils are oriented in relationship to one another and are connected to one another in at least one location. In various embodiments, the individual first elongated tendrils can be positioned in side-by-side relationship and can be present in one or more overlying layers. The positioning of the respective first elongated cleaning tendrils can be oriented relative to one another in a manner that facilitates uptake of various cleaning solutions and transfer to the surface to be cleaned. Where multiple layers of first elongated tendrils are present in the mop strand bundle, the individual first elongated cleaning tendrils can be located offset to ones in the adjacent or associated layers, in directly overlying relationship to those in the adjacent layers or associated layers or a mixture of the two as desired or required in various embodiments.

In various embodiments, the first elongated cleaning tendrils possesses a first surface roughness. Surface roughness as this term is used herein is defined as the degree of abrasiveness possessed by the object such as the first elongated cleaning tendril. Roughness can be determined by the degree of unevenness of the surface of the object below the scale of its shape or waviness but above the irregularity of any crystal lattices present. The surface roughness of the material contributes to abrasively of the material in question. It is within the purview of this disclosure that the first surface roughness of the first elongated cleaning tendrils can vary within a defined tolerance among the first elongated tendrils present in the mop strand bundle such that the population of first elongated cleaning tendrils collectively defines an average first surface roughness value, if desired or required.

In certain embodiments, some or all of the first elongated cleaning tendrils can be yarn members composed of natural and/or synthetic polymeric twist fibers. Where desired or required, the twist fibers can be twisted around a suitable microfiber monofilament. In certain embodiments, the first elongated cleaning tendrils can be composed in whole or in part of fabric strips which can be composed of woven or non-woven fabric or mixtures thereof. In certain embodiments, the fabric strips can be tubular fabric material. Where desired or required, the fabric can be composed in whole or in part of microfiber material.

The first elongated cleaning tendrils can be configured in a manner that promotes uptake of cleaning liquid from a bucket or other suitable vessel as well as dispersal of cleaning liquid on to the floor surface. Pressing or wringing of the first elongated cleaning tendrils can facilitate removal of excess cleaning fluid together with particulate dirt that has been dislodged from the floor surface during cleaning operations.

The materials employed in the first elongated cleaning tendrils will possess the ability to absorb and release cleaning fluid during cleaning operations. Non-limiting examples of materials include various yarns, cloth tabs and the like. It is contemplated that the first elongated cleaning tendrils can be looped members or can be cut members as desired or required. It is also contemplated that the first elongated cleaning tendrils can be a mixture of the two.

The first elongated cleaning tendrils, when in position in the mop strand bundle can be layered relative to one another and can form a mop strand bundle length and width as would be desired to the particular cleaning operation. In certain embodiments, the mop strand bundle and associated mop is typically manufactured and sold by weight designation. Provisions for specific lengths and widths are assumed to be flexible and can vary based on yarn diameter and weight The first elongated cleaning tendrils can be bundled together by suitable bundling means such as a tendril connecting member. The tendril connecting member can be configured In certain embodiments, the first elongated cleaning tendrils various can be stitched together such that the respective first elongated cleaning tendrils are positioned in the desired side-by-side relationship with stitching extending in generally crosswise relationship over the various first elongated cleaning tendrils.

Where desired or required, the stitching feature can be employed alone or in combination with other tendril connecting members. In certain embodiments, the tendril connecting member can be configured as a headband. Where desired or required, the headband can be configured as a flexible planar sheet that is positioned in overlying fixed relationship to the plurality of first elongated cleaning tendrils that positioned is between the respective first and second ends of the associated first elongated cleaning tendrils. In certain embodiments, the headband can be configured as a strip that encircles the first elongated cleaning tendrils and maintains them in fixed relationship to one another. The associated first elongated cleaning tendrils can be maintained in place relative to the headband by any suitable means such as stitching and the like.

The headband can be positioned relative to the associated first elongated cleaning tendrils at any location between the first and second ends of the tendrils. In certain embodiments, the headband can be located midway between the first and second ends. It is also within the purview of this disclosure that the headband be offset from the midpoint if desired or required. Where desired or required, the headband can be composed of a woven mesh material and can have a headband roughness. Non limiting examples of material that can be used in the certain embodiments of the headband include polymeric mesh, natural fiber mesh, synthetic woven fabric such as a polymeric canvas and the like, natural fiber woven fabric as well as mixtures of the aforementioned.

The mop strand bundle as disclosed herein also includes at least one second elongated cleaning tendril. The at least one second elongated cleaning tendril is configured with a first end, a second end opposed to the first end and opposed side edges extending between the first end and the second end of the second elongated cleaning tendril. The at least one second elongated cleaning tendril is positioned in moveable relationship with the first elongated cleaning tendrils present in the mop strand bundle. The at least one second elongated cleaning tendril is connected to plurality of first elongated cleaning tendrils of the mop strand bundle in at least one location. Where desired or required, the first end of the at least one second elongated cleaning tendril can be connected to the headband at a suitable location and can extend outward therefrom.

The at least one second elongated cleaning tendril will have a surface roughness greater than the first surface roughness possessed by the plurality of first elongated cleaning tendrils. The second surface roughness present provided by the at least one elongated cleaning tendril will be sufficient to sequentially dislodge and remove contact with and/or adhesion to surface dirt and grime from contact with and/or adhesion to the floor surface. In certain embodiments, the second surface roughness of the at least one second elongated cleaning tendril can be equal to or greater than the surface roughness of the headband.

In certain embodiments, the at least one second elongated cleaning tendril can include a woven or non-woven material. In certain embodiments, the material can be composed in whole or in part of woven material having an enhanced stiffness. Stiffness can be ascertained by test methods such as ISO 9073-7 and ASTM D1388. The materials employed in the at least one second elongated cleaning tendril will also exhibit enhanced abrasiveness over the material employed in the first elongated cleaning tendrils. In certain embodiments, this may be ascertained by the Wyzenbeek test or the Martindale test. In certain embodiments, the material employed in the at least one second elongated cleaning tendril will have a Martindale values of 40000 or greater while the material employed in the first elongated cleaning tendrils will have a value of approximately 50% less than that.

The at least one second elongated cleaning tendril can be of a size and configuration sufficient to contact the associated floor surface and dislodge and remove grit, grime and/or biofilm that adheres to the floor surface. Where desired or required, the woven or non-woven material employed can be configured with a plurality of bristle-like projections that can project outward from the body of the second elongated cleaning tendril at any suitable angle to provide mechanical abrasive action when the mop device is in use. In certain embodiments, the material can be composed of cut pile fibers, loop or mixtures of the two. In certain embodiments, the synthetic pile elements present in the material can be composed, at least in part of at least one of the following polyamides, polyesters, polyethylene, vinyl-vinylidene chloride, polyvinyl chloride, polyacrylonitrile, cellulose acetate, cellulose triacetate, rayon, glass and the like. Where desired or required, the synthetic pile fibers such as those present in the material can include extruded monofilaments and may be configured as monofilament ribbons. In certain embodiments, the monofilaments can have size between 5 and 500 denier; greater than 500 denier; greater than 700 denier; greater than 120 denier; between 300 denier and 1200 denier; between 500 and 1200 denier; between 700 and 1200 denier.

The surface of the at least one elongated cleaning tendril is configured of sufficient roughness or unevenness and of sufficient toughness to facilitate the removal of large, loosely held dirt and grime deposits from the floor surface to be cleaned. The surface of the at least one elongated cleaning tendril should also have sufficient abrasiveness to facilitate the removal of hard, low volume deposits which adhere strongly to the floor surface.

In certain embodiments, the at least one second elongated cleaning tendril can be composed in whole or in part of polymer-based material. Non-limiting examples of suitable polymer-based materials include sparse unwoven polymers such as cellulose, nylon, spun polyethylene, spun polypropylene or mixtures thereof. Where desired or required the material can also incorporate one or more hardening materials such as alumina, titanium oxide or suitable resins. Non limiting examples of suitable material include materials commercially available from 3M under the name Scotch Brite.

The at least one elongated second cleaning tendril can have at least one cleaning surface configured to contact the floor surface. Where desired or required, the at least one cleaning surface can be planar or essentially planar. In certain embodiments, the at least one second elongated cleaning tendril can have a cross-sectional area that is greater than the cross-sectional area of individual first elongated cleaning tendrils.

In certain embodiments, the at least one second elongated cleaning tendril can be configured as an elongated rectilinear or tubular member having a cross-sectional area that is greater than the cross-sectional area of individual first elongated cleaning tendrils. In certain embodiments the cross-sectional area of the at least one second elongated cleaning tendril can be at least 50% greater than the cross-sectional area of individual first elongated cleaning tendrils; greater than 100%; greater than 150%. In certain embodiments, the at least one second elongated cleaning tendril can be configured as a flexible strip of suitable agitator material. In certain embodiments, the at least one second elongated cleaning tendril can be configured such that flexible agitator material surrounds and inner core of compressible material such as polymeric foam or the like.

In certain embodiments, the mop strand bundle can also include at least one tailband. The tailband can be located at spaced relationship from the cleaning tendril connecting member and can be positioned in fixed relationship with the first elongated cleaning tendrils at a location distal to the headband. Where desired or required, the headband can be positioned at a position proximate to the second ends of the respective first elongated cleaning tendrils. Where desired or required, the at least one second elongated cleaning tendril can be connected to the tailband by any suitable means such as stitching or the like. In certain embodiments, the strand bundle can include two or more second elongated cleaning tendrils. In the embodiment depicted in FIG. 2, the five second elongated cleaning tendrils are dispersed on each side of a suitable headband member. In the embodiment depicted in FIGS. 1 through 12, two second elongated cleaning tendrils are positioned in the central region of the strand bundle on each side of the headband.

The mop device 10 described in this disclosure is composed of a handle 11 connected to a suitable mop head 12. Connection between handle and mop head can either be permanent or detachable. It is contemplated that the handle 11 can be composed of suitable metal, plastic or wood as desired or required.

The mop head 12 can be composed of a suitable plastic or metal material. The mop head 12 will be configured to engage the strand bundle 14. Various configurations of the mop head 12 are disused in this disclosure. In various embodiments depicted, the mop head is configured to releasably contact and engage the strand bundle 14. While releasable engagement is depicted in the various drawing figures, it is contemplated that the wet mop 10 disclosed herein can have the mop strand bundle permanently attached to the handle 11 as by means of the associated mop head 12.

In the use configuration, the mop head 12 is connected to a suitable mop strand bundle 14. The handle 11 can be of any suitable configuration. As broadly construed the mop head 12 can also have any suitable configuration. In various embodiments depicted herein the mop head 12 can be configured to be releasably attached to the handle 11. Connection can be by any suitable attachment means including but not limited to mating threaded screws, clamps and the like. It is also within the purview of this disclosure that the mop head 12 will be integrally formed the handle 11 as desired or required. The mop portion or mop strand bundle 14 as disclosed herein can be removably connected to the mop head 12 as desired or required.

The mop head 12 can be configured to releasably position the threaded bundle 14 in an operative position relative to the handle 11. Mop head 12 will include a suitable body 30 having means 32 for connecting the mop head 14 to the handle 11. A non-limiting example of such connection means is mating threaded surfaces on the end of handle 11 configured to be received in a suitably mating orifice defined in the mop head body 30.

The body 30 of mop head 12 also includes suitable means 34 for releasably positioning the strand bundle 14 in the mop head 12. In the various embodiments, the strand bundle 14 connecting means can be configured as a suitable clasp or the like. Various connection mechanisms are presented in the various drawing figures. It is also considered to be within the purview of this present disclosure that the strand bundle 14 be permanently mounted relative to the mop head 12.

The first elongated cleaning tendrils or strands 16 may be positioned in a plurality of layers in various embodiments in order to provide thickness and enhance the mop strand bundle 14. Thus, multiple layers of first elongated cleaning tendrils or strands 16 can be positioned side by side can be integrated into a mop strand bundle 14. The individual first elongated cleaning tendrils or strands 16 suitably configured can be attached to each other to form a unit by employing suitable attachment mechanisms such as a cleaning tendril connecting member. In various embodiments the individual first elongated cleaning tendrils or strands 16 can be stitched to one another to form an attachment means that is essentially perpendicular to the orientation of the elongated individual first elongated cleaning tendrils or strands 16. Non-limiting examples of attachment means include direct stitching (not shown) and/or connection or affixing of a suitable headband 18. Where desired or required, the mop strand bundle 14 can employ both stitching and a headband. In the embodiments depicted, the wet mop device 10 includes at least one headband 18 that is positioned between the first ends and second ends of the plurality of first elongated cleaning tendrils 16 with headband 18 in releasable contact with the mop head 12. In the embodiment depicted in FIG. 1, the headband 18 is positioned midway between the first ends and second ends of the plurality of first elongated cleaning tendrils 16 such that the plurality of first elongated cleaning tendrils 16 form two segments of essentially equal length extending from either side of the associated mop head 12.

The headband 18 can be of any suitable band width, unit width and thickness. Band width is measured along a plane generally perpendicular to that length defined by the longitudinal plane coplanar with the elongated yarns or strands when the first elongated cleaning tendrils 16 are oriented in their parallel elongated positions. Unit width is defined as the width of the headband as extending from side end 20 to side end 20 of the mop strand bundle 14. Thickness is the measurement of the headband material from outer face to inner face. In various embodiments, the headband 18 has a width that can vary from less than 1" to 8" or greater.

The headband can be composed of various materials. However, the primary material can be a 100% polyester material that has been sized for increased stiffness and strength. The mop strand bundle 14 of wet mop device 10 such as may also include at least one tailband 22. The tailband 22 can be made from various blends of materials; in certain embodiments, the preferred material will be a 100% polyester material. The polyester material can be configured as a mesh where desired or required can be configured to provide a suitable abrasive surface. Where desired or required, the tailband 22 can have a width greater than the width than headband 18. The at least one tailband 22 can be positioned proximate to respective ends of associated plurality of first elongated cleaning tendrils 16.

The tailband can be affixed to the plurality of first elongated cleaning tendrils 16 by any suitable means such as stitching or the like. In the embodiment illustrated in FIG. 1, the tailband can be an elongated woven or non-woven fabric tape extending from side edge 20 to side edge 20. In certain embodiments, the at least one tailband 22 can be positioned such that the major portion of the side length of the respective first elongated cleaning tendrils 16 is positioned between the headband 18 and the tailband 22 In certain embodiments, the tailband 22 can be positioned such that the space between headband 18 and tailband 22 will comprise between 60 and 95% of the mop face space. In certain embodiments the distance between the tailband 22 the respective ends of the associated first elongated cleaning tendrils 16 can be between 1 and 4 inches.

It is also contemplated, in certain embodiments, that the wet mop device 10 can be composed of one or more components that are biodegradable or partially biodegradable. In certain embodiments, it is contemplated that devices such as those disclosed herein will be designed such that each individual component which makes up the mop strand bundle 14 of the mop device is determined to be biodegradable when processed in a composting environment. Biodegradable components can include headband material that is biodegradable when placed in composting environment. The tail band such as tail band 22 also can employ a material that is biodegradable when placed in a composting environment. The thread material used for stitching the mop may also be composed in whole or in part of a biodegradable material when placed in a composting environment. Also, any printed label used on the mop strand bundle 14 to define its part number or private label information can employ an earth friendly ink printed onto a label material that will dissolve when placed in a chemical or in a composting environment. The some or all of the plurality of first elongated cleaning tendrils 16 can be composed of blended yarn material in which the fibers of the yarn material will breakdown in a composting environment.

The mop strand bundle 14 can also include one or more additional tailbands such as tailband 29 as illustrated in FIG. 1. Where an additional tailband is employed, the additional tailband can be positioned at a location between the headband 18 and the tailband 22. In certain embodiments, the additional tailband 29 can be made from various blends of materials and can be the same or different from material employed in the tailband 22; in certain embodiments, the preferred material can be a 100% polyester material. The polyester material can be configured as a mesh where desired or required can be configured to provide a suitable abrasive surface. Where desired or required, the at least one additional tailband 29 can have a width greater than the width than headband 18. The at least one additional tailband 29 can be positioned proximate to respective ends of associated plurality of first elongated cleaning tendrils 16.

The mop strand bundle 14 also includes at least one second elongated cleaning tendril 36. The at least one second elongated cleaning tendril 36 includes a first end, a second end opposed to the first end and opposed elongated side surfaces. The at least one second elongated cleaning tendril 36 can be in abutting and/or overlying relationship with the first elongated cleaning tendrils 16 and can be connected to the plurality of first elongated cleaning tendrils 16 in at least one location. The at least one second elongated cleaning tendril 36 has a second surface roughness that is greater than the surface roughness exhibited by the first elongated cleaning tendrils 16.

The at least one second elongated cleaning tendril 36 can be connected to the mop strand bundle 14 at a location that extends from the headband 18 and terminates at a location at a location distal to the headband 18 at an orientation that is co-linear with the plurality of first elongated cleaning tendrils 16 and can move in coordinated manner with the plurality of first elongated cleaning tendrils 16 as the mop strand bundle is drawn across the floor surface to be cleaned. In certain embodiments the at least one second elongated cleaning tendril 26 can be connected to the headband 18 by stitching tacking or other suitable means. Connection of the at least one second elongated cleaning tendril 36 can be on the external surface of the headband 18 or on the interior surface of the headband 18. In the embodiment illustrated in FIG. 1, the first end of the at least one second elongated cleaning tendril 36 is connected to the exterior surface of the headband 18.

The configuration illustrated in FIG. 1 includes one second elongated cleaning tendril 36 which can be located at any suitable location relative to the plurality of first elongated cleaning tendrils 16. In the embodiment illustrated the second elongated cleaning tendril 36 is located proximate to one side edge 20.

In certain embodiments, the second elongated cleaning tendril 36 can be attached to one or more of the tailbands 22, 29 at a location distal to the headband 18. Connection can be accomplished by any suitable device such as sewing tacking or the like and will permit the second elongated cleaning tendril 28 to contact the floor surface to be cleaned as the mop strand bundle 14 is drawn across the floor during cleaning operations.

The unique design of the wet mop device 10 and/or the mop strand bundle 14 as disclosed herein permits allow for more contact points between both the plurality of first elongated cleaning tendrils 16 and the second elongated cleaning tendril 36 of the mop strand bundle 14 and the floor surface area to be cleaned. In a manner that permits the rough surface of the second elongated cleaning tendril 36 to sequentially dislodge dirt and grime adhering to the floor surface. The dislodged dirt and grime can be collected on the plurality of first elongated cleaning tendrils 16 and released with rinsing as needed during cleaning operations.

It is also believed that increased contact points for the plurality of first elongated cleaning tendrils allow for more fluid absorption and/or release. The result can be more fluid absorbed from the floor surface and/or cleaning fluids released onto the floor surface to improve clean-ability/soil load pick-up.

As depicted in various embodiments and as broadly construed, the mop strand bundle can include a plurality of elongated first cleaning tendrils with each first elongated cleaning tendril having a first end and an opposed second end. The first elongated cleaning tendrils are oriented in parallel relationship to one another and connected to one another in at least one location with each cleaning tendril having a first surface roughness. Where desired or required, at least a portion of the first elongated cleaning tendrils can be composed of elongated strips of flat woven fiber strips, flat nonwoven fiber strips, flat woven fiber loops, flat nonwoven fiber loops, yarn members or mixtures thereof. The tendrils can be cut members, looped members or mixtures thereof. It is also contemplated that the yarn members can include microfibers, if desired or required.

The mop strand bundle also includes at least one second elongated cleaning tendril. The at least one second elongated cleaning tendril has a first end, a second end opposed to the first end and opposed elongated side surfaces. The at least one second elongated cleaning tendril is oriented in parallel relationship to at least one opposed elongated edge in abutting and moveable relationship with at least one first cleaning tendril and connected to the plurality of first elongated cleaning tendrils in at least one location, the wherein the at least one second elongated cleaning tendril having a second surface roughness with the second surface roughness being greater than the first surface roughness of the first elongated cleaning tendrils.

Where desired or required, the at least one second elongated cleaning tendril includes a woven mesh material. In certain embodiments, the at least one second elongated cleaning tendril can be a tubular member having at least one outer surface region composed of woven mesh material. In certain embodiments, the tubular member can be hollow or partially hollow. In certain embodiments, the tubular member can include a central packing. The central backing can be absorbent and or porous. Suitable materials are those that can be subjected to fluid removal as by mechanical wringing and the like. Non-limiting examples include polymer foam and the like. The at least one second elongated cleaning tendril can be attached to the headband by any suitable manner and can be attached to one or more tailbands at a location distal to the headband attachment point.

Where desired or required, the various second elongated cleaning tendrils can be located on a first face of the mop strand bundle, a second face of the mop strand bundle or both. In certain embodiments, the mop strand bundle includes at least two second elongated cleaning tendrils. Where desired or required the at least two second elongated cleaning tendrils can be oriented in close or abutting relationship in a central location on the mop strand bundle. In certain embodiments, the second elongated cleaning tendrils 36 can be located in opposed sides of the respective mop strand bundle.

The mop strand bundle can also include a headband that is positioned in overlying fixed relationship to the plurality of elongated first cleaning strands and the at least one elongated second cleaning tendril at a location between the first and second ends of the plurality of elongated first cleaning tendrils.

The mop strand bundle can also include at least one tailband that is positioned in overlying fixed relationship with the plurality of first elongated cleaning tendrils at a location distal to the headband. Where desired or required the mop strand bundle can include two or more tailbands located in parallel relationship to one another and perpendicular to the first elongated cleaning tendrils. Where desired, the at least one elongated second cleaning tendril can also be connected to the at least one tailband at a location distal to the headband.

Figure 6:
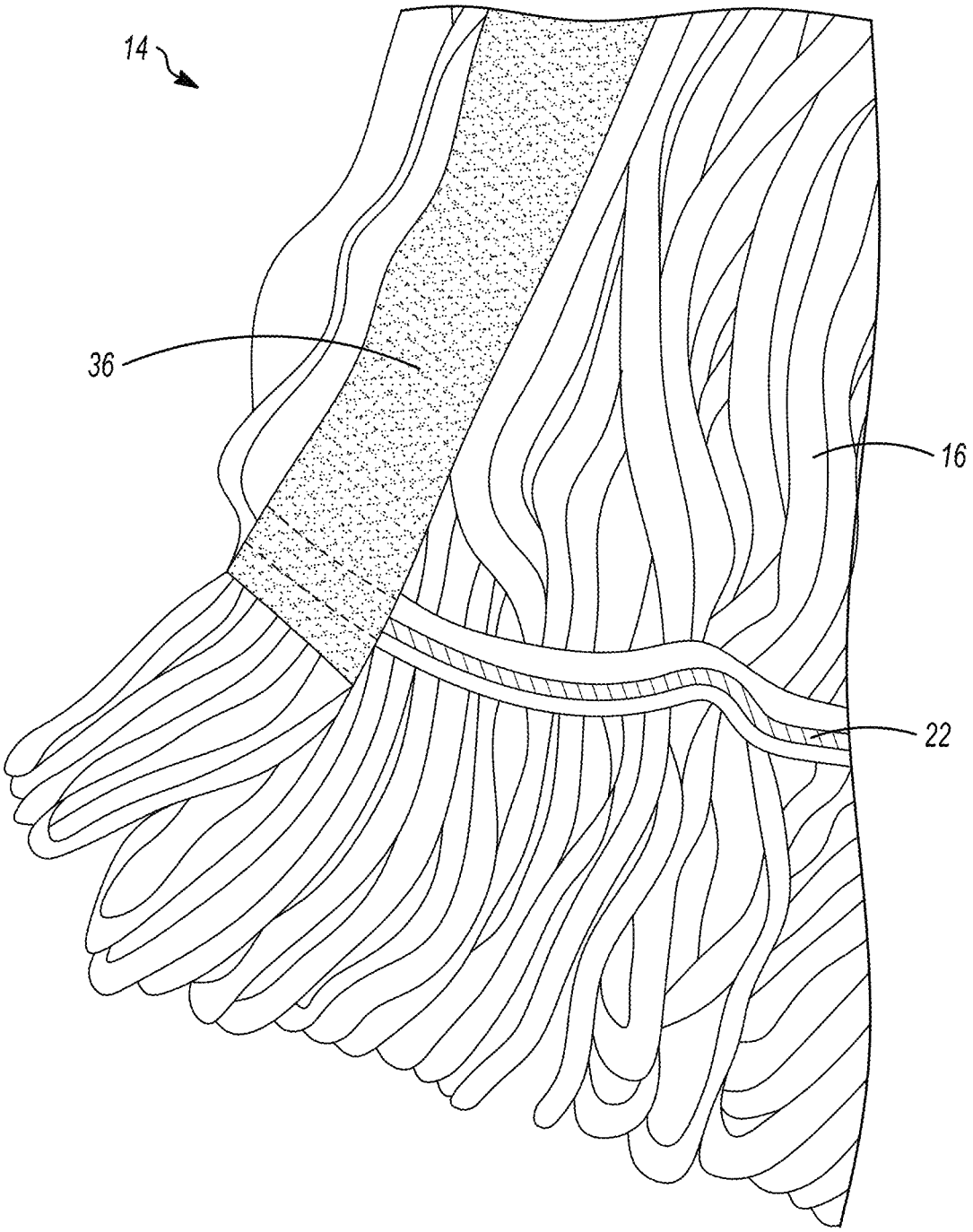
FIG. 6 is a detail view of the tailband junction of the mop strand bundle of FIG. 2.
Figure 7:
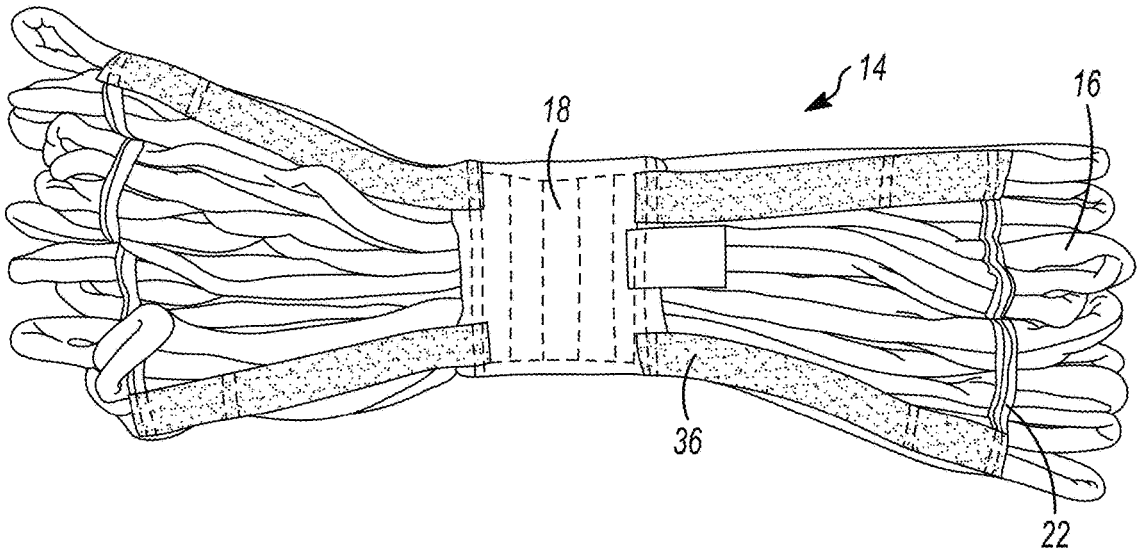
FIG. 7 is a plan view of a second embodiment of the first side of a mop strand bundle as disclosed herein configured with microfiber fabric strips.
Figure 8:
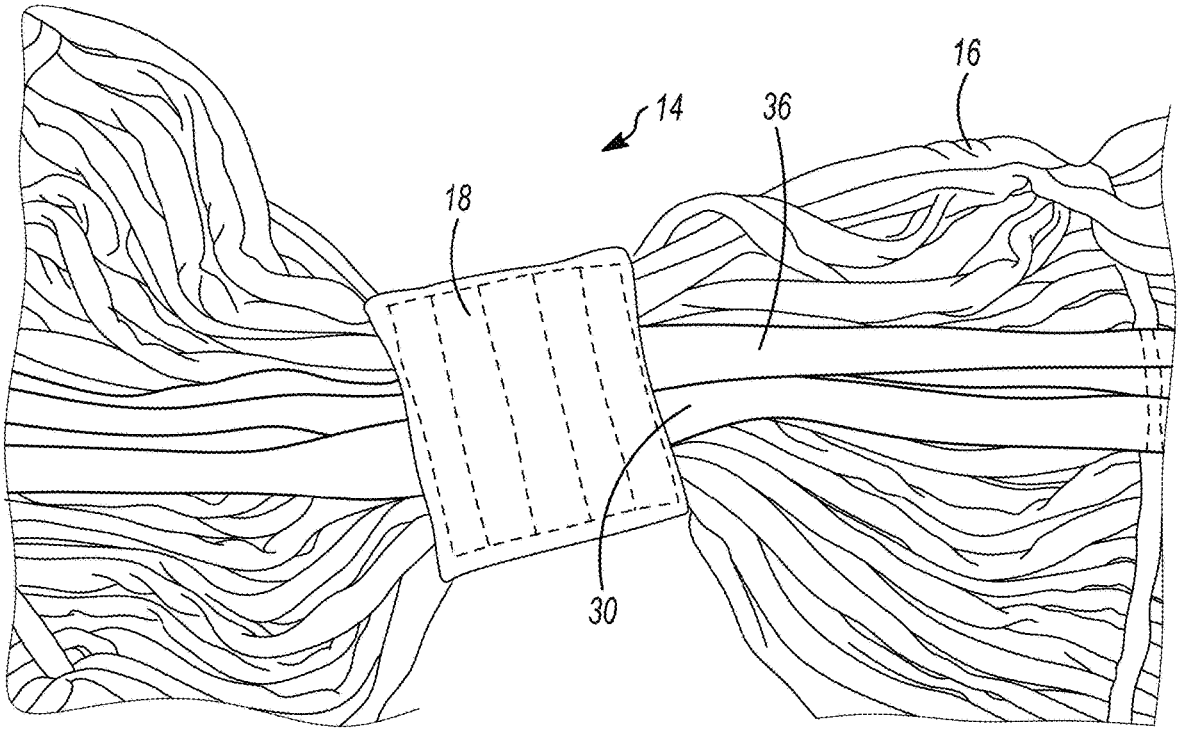
FIG. 8 is a detail view of a third alternate embodiment of a mop strand bundle as disclosed herein.
Figure 9:
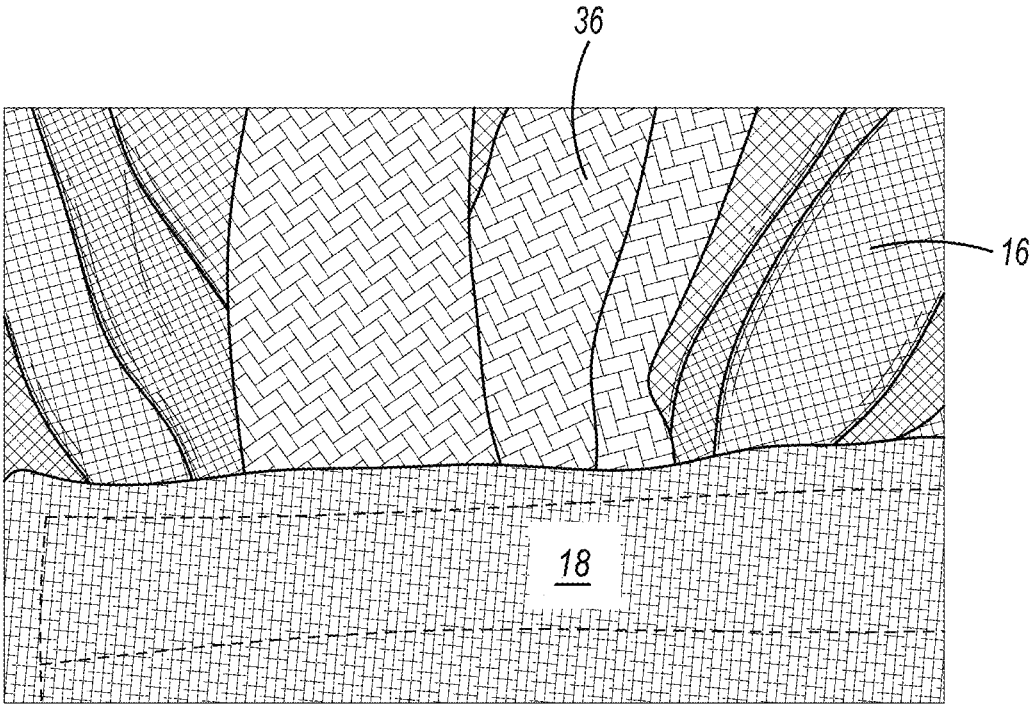
FIG. 9 is a detail view of the mops strand bundle if FIG. 8.
Figure 10:
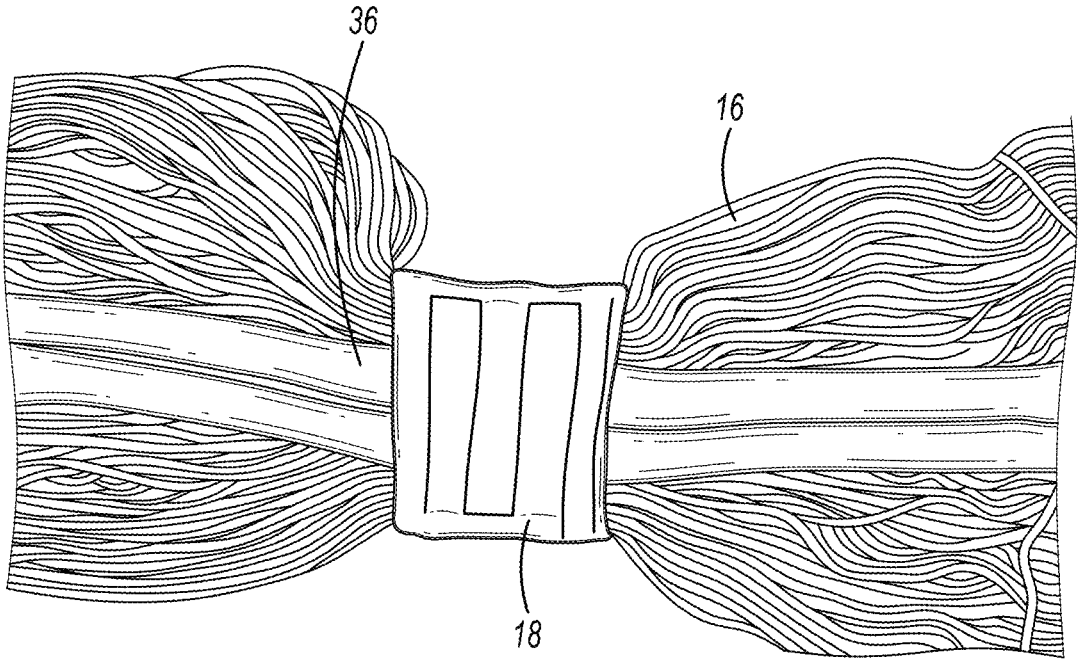
FIG. 10 top plan view of a fourth alternate embodiment of a mop strand bundle as disclosed herein.
Figure 11:
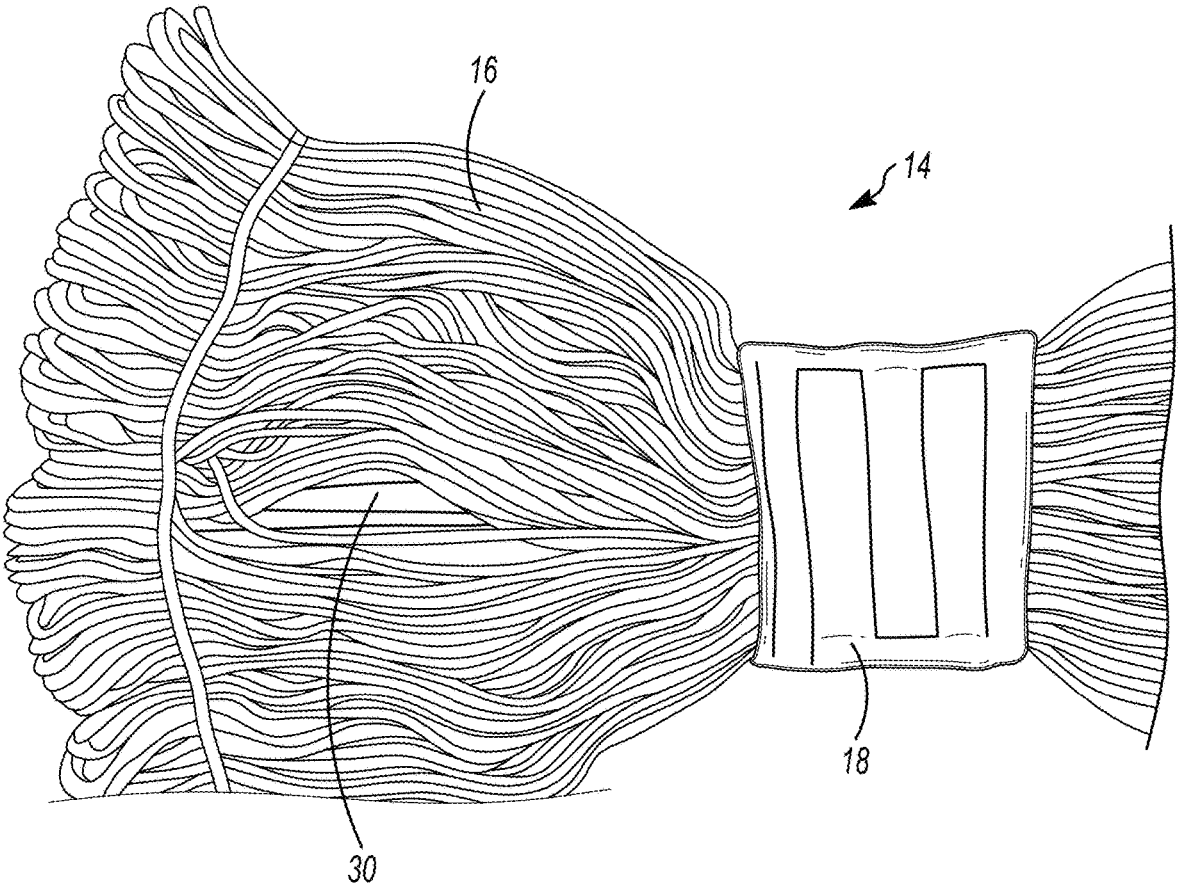
FIG. 11 is a partial bottom plan view of the mop strand bundle of FIG. 10.
Figure 12:
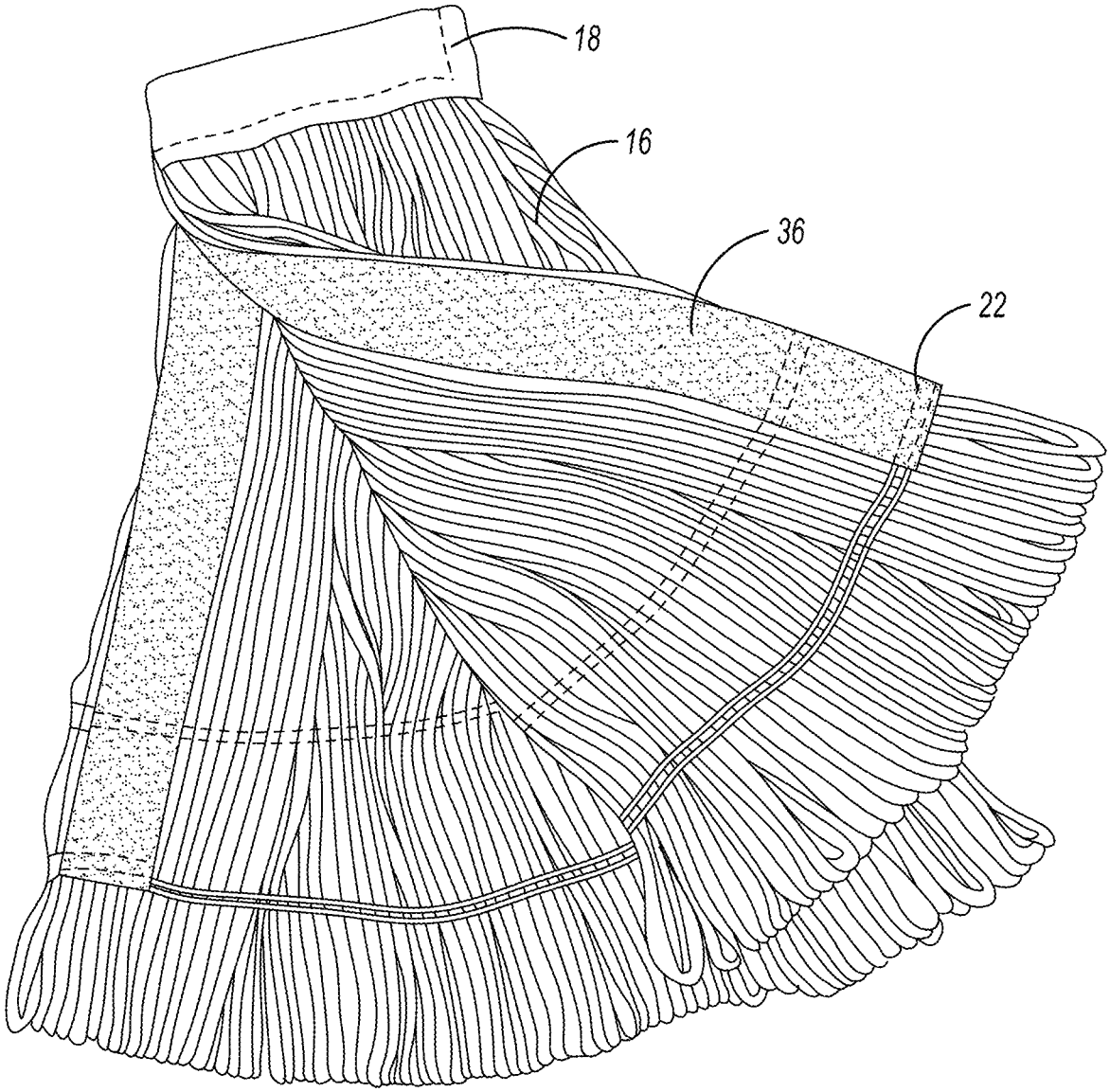
FIG. 12 is a view of a fifth embodiment of the mop strand bundle as disclosed herein. is a bottom view of the first alternate embodiment as depicted in FIG. 14.

Turning to the embodiment depicted in FIGS. 2-5, mop strand bundle 14 is configured with a plurality of first elongated cleaning tendrils 16 that are composed, at least in part, of spun yarn fibers. The spun yarn fibers can be in the either looped, cut-lopped or a mixture of the two. In FIGS. 2-5, the yarn fibers are looped. In FIGS. 6-7, the first elongated cleaning tendrils are composed of fiber strips such as microfiber strips.

The first elongated cleaning tendrils 16 of the mop strand bundle 14 of FIGS. 2-7 are connected to a headband 18 located midway between the first ends 50 and second ends 52 of the respective first elongated cleaning tendrils 16. It is also within the purview of this disclosure to located the headband 18 at other positions between the first and second ends as desired or required. In the embodiment illustrated in FIGS. 2-7, headband encircles the first elongated cleaning tendrils 16 which are further maintained in positioned by stitching. The headband 18 can have a suitable headband width Wh and thickness Th to maintain the first elongated cleaning tendrils 16 in an operative position and permit releasable contact with a suitable mop head such as mop head 14.

In the embodiment illustrated in FIGS. 2-7, the mop strand bundle 13 has four second elongated cleaning tendrils 36 positioned in spaced relationship to one another. In the embodiment depicted in FIGS. 2-7, the four second elongated cleaning tendrils 36 are positioned proximate to the respective side edges 20, 20 of the headband 18 and are affixed to the mop strand bundle 13 at or near a first end by stitching to the exteriorly facing surface of the headband 18. Each respective second elongated cleaning tendril 36 extends outwardly from the headband 18 and terminates at a location distal to the headband 18.

The second end of one or more of the second elongated cleaning tendrils 36 can be fastened to the mop strand bundle 36 at a location distal to the headband 18 such that the second elongated cleaning tendrils 36 are oriented lengthwise in essentially the same direction as the first elongated cleaning tendrils 16. Fastening can be accomplished in a manner suitable to permit a degree of freedom of movement of each second elongated cleaning tendril 36 relative to the associated first elongated cleaning tendrils 18. In the embodiment illustrated in FIGS. 2-7, the second end of each second elongated cleaning tendril 36 is affixed to a tailband 22 located proximate to the ends of the first elongated cleaning tendrils 18 by stitching, tacking or the like. Where desired or required, the tailband 22 can have a length Lt that is greater than the length Lh of the associated headband 18. The length Lt of the tailband can be between 10% and 75% greater than the length Lh; between 10% and 50% greater; between 20 and 50% greater and the like.

The second elongated cleaning tendrils 36 can have a width Ws that is less than the width Wh of headband 18. In certain embodiments, the certain embodiments the width Ws of given second elongated cleaning tendril 36 is between 1% and 20% of the thickness Th of headband 18. In the embodiment illustrated in FIGS. 2-7.

Where desired or required, the second elongated cleaning tendrils 36 can be positioned relative to one another in a manner that permits contact between the floor to be cleaned and both the plurality of first elongated cleaning tendrils 16 and the one second elongated cleaning tendrils 36 in a moveable manner as the mop device 10 is drawn across the floor surface in variable patterns such as a figure eight or the like. In the embodiment illustrated in FIGS. 2-7, the four second elongated cleaning tendrils are symmetrically disposed on one side of the mop string bundle with the second elongated cleaning tendrils on a given side of the headband in spaced relationship to one another. strand bundle 14 can be oriented such that the second elongated cleaning tendrils 36 symmetrically or asymmetrically as desired to required.

When the mop strand bundle 14 is in the use position, the two halves of the mop strand bundle will be doubled on top of one another such that the plurality of first elongated cleaning tendrils 16 from the two respective sides can overlay one another. The associated second elongated cleaning tendrils 36 can be oriented such that they are outwardly facing or inwardly oriented facing as desired or required.

It is also within the purview of this disclosure, to include second elongated cleaning tendrils 36 on both sides of the mop strand bundle 14 if desired or required. When the second elongated cleaning tendrils 36 are on opposed faces of the mop strand bundle 14, the individual second elongated cleaning tendrils can be positioned opposed to one another or can be placed in staggered orientation as desired or required. It is also contemplated that second elongated cleaning tendrils 36 can be symmetrically relative to the headband 18 or can be asymmetrically disposed as desired or required.

The second elongated cleaning tendril 36 can have any suitable configuration to produce the desired agitation action. In the embodiment, depicted in FIGS. 2-7, the second elongated cleaning tendrils 36 can be configured as a flexible strip composed of stiff woven or non-woven fibers positioned in a layer-like fashion. In the embodiment depicted in FIGS. 8-11, the second elongated cleaning tendrils are configured as rod-like member having a woven abrasive fabric covering its outer surface. It is also within the purview of this disclosure to configure the mop strand bundle 14 with a combination of second elongated cleaning tendrils 36 having different configurations.

In order to further illustrate the present disclosure, the following non-limiting examples are presented.

Example I

Figure 2:
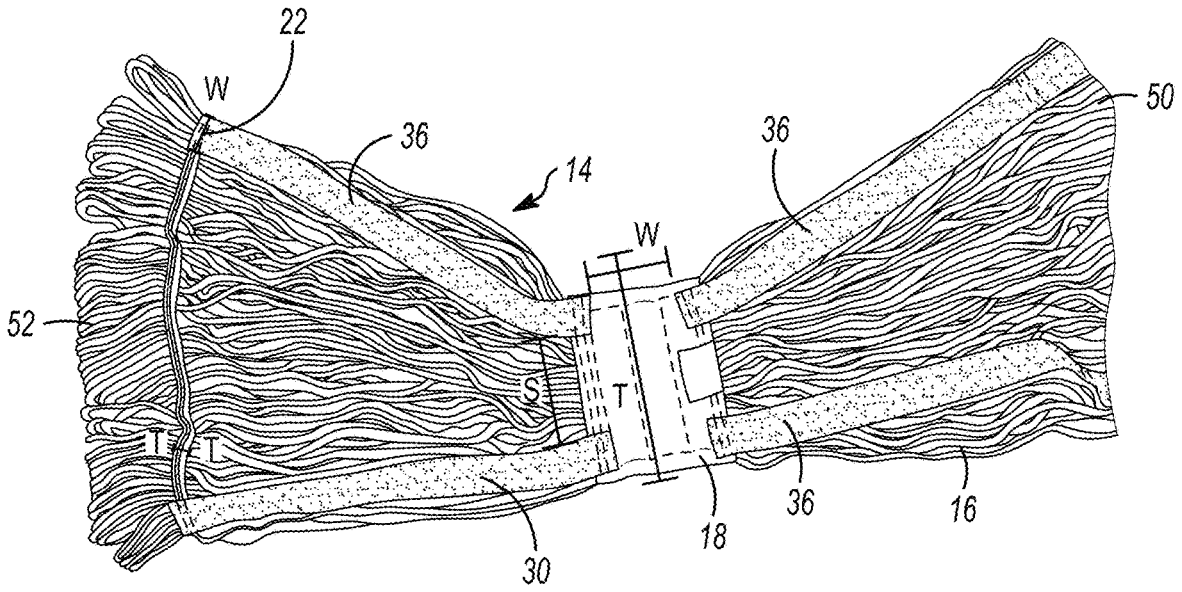
FIG. 2 is a plan view of a first embodiment of the first side of a mop strand bundle as disclosed herein configured with yarn strands.
Figure 3:
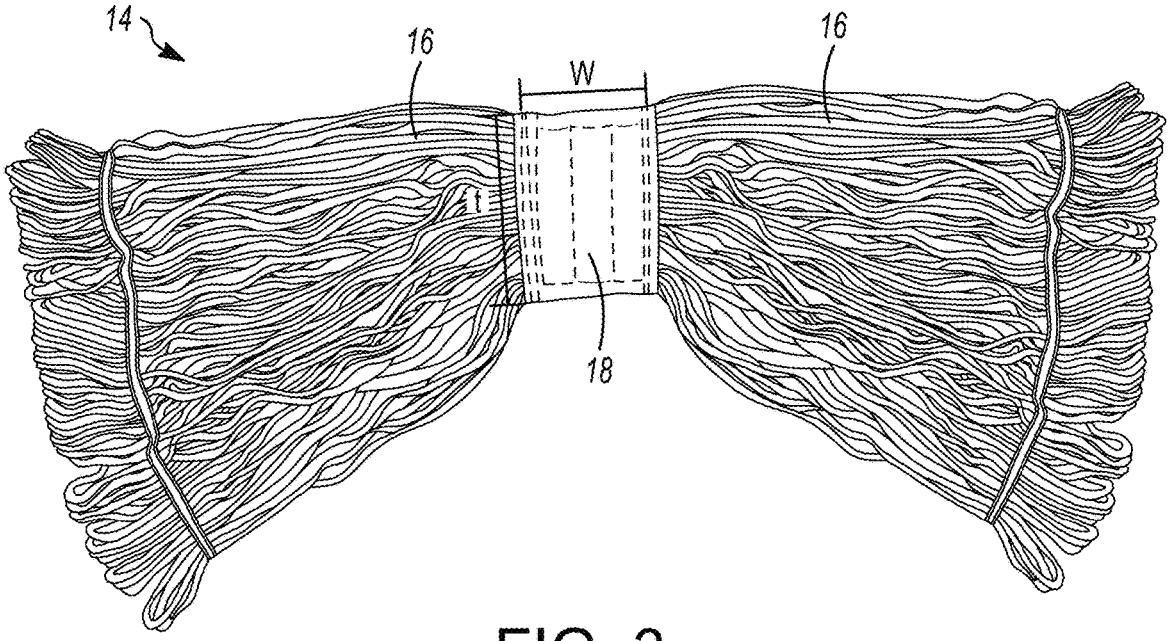
FIG. 3 is plan view of the second side of the mop strand bundle of FIG. 2.
Figure 4:
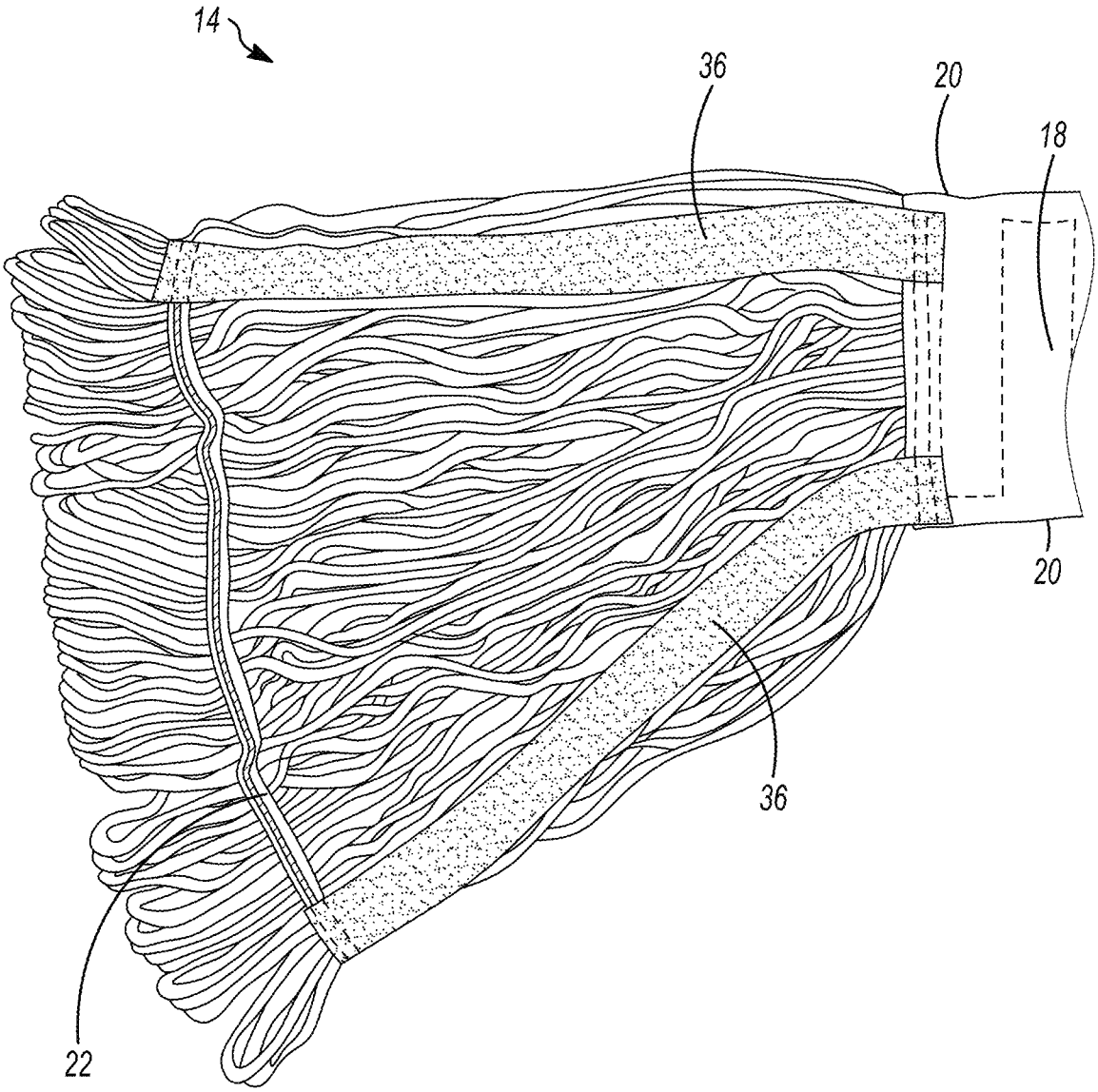
FIG. 4 is a partial view of the mop strand bundle of FIG. 2.
Figure 5:
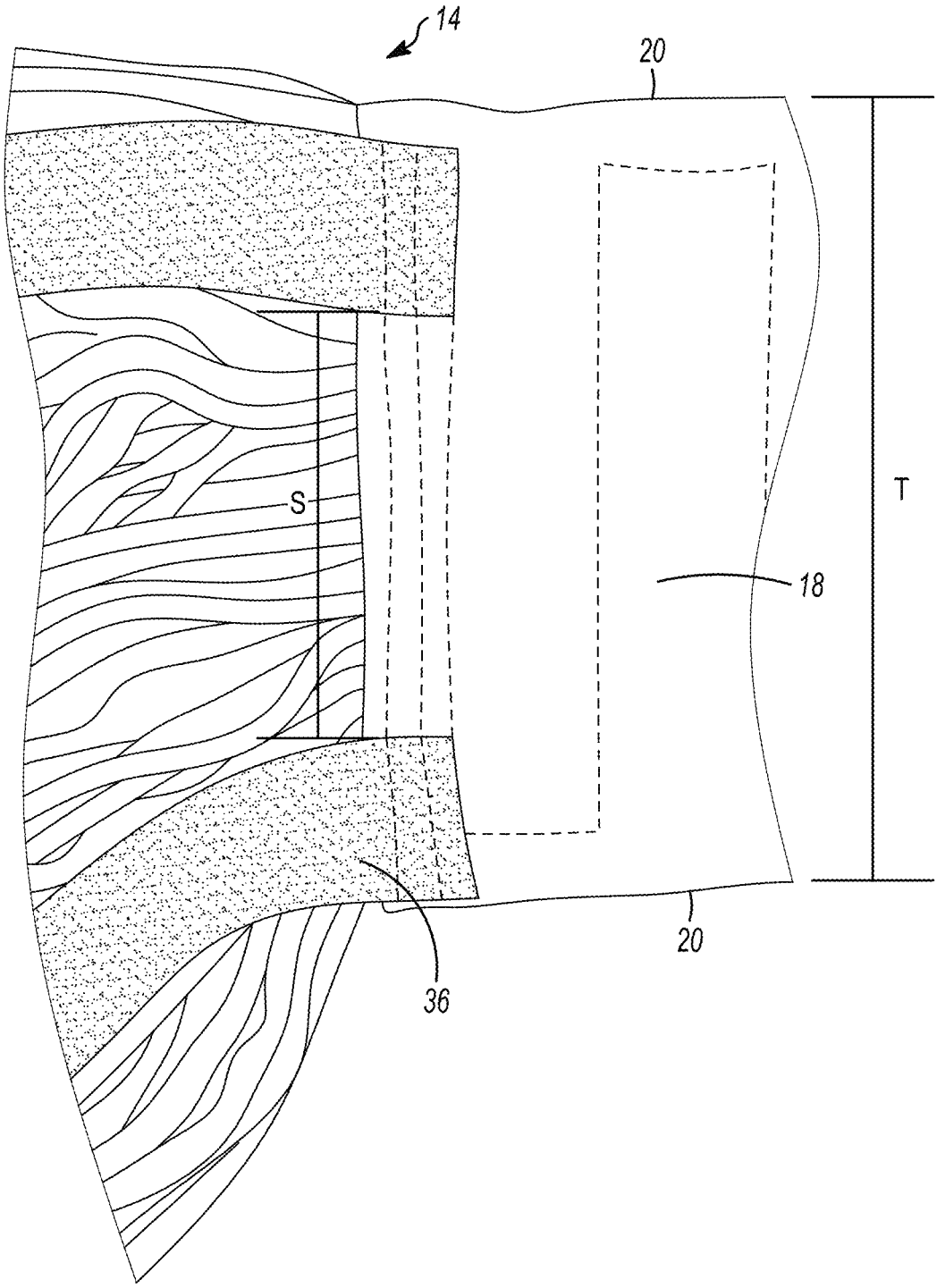
FIG. 5 is a detail view of the headband junction of the mop strand bundle of FIG. 2.

In order to assess the cleaning ability of the mop strand bundle as disclosed herein, a mop strand bundle having the configuration as illustrated in FIG. 2 is prepared using looped yarn members as the plurality of first elongated cleaning tendrils positioned in side-by-side abutting relationship held in place with headband as the cleaning tendril connecting member with the yarns projecting outward from both sides of the headband in an essentially symmetrical manner. The yarn members that function as the plurality of first elongated cleaning tendrils 16 provide a test mop strand bundle 14 having a 10-pound dry weight with first elongated cleaning tendrils having an average length of 18 inches as measured from headband edge to tendril edge.

The test mop strand bundle 14 is also configured with four second elongated cleaning tendrils symmetrically disposed in the mop strand bundle 14 in the manner illustrated in FIG. 2. The four second elongated cleaning tendrils 30 in the test mop strand bundle are each connected to the headband at one end and to the tailband at the other end. The four second cleaning tendrils present in the test mop strand bundle employed has a length of 15 inches as measured from the headband to each distal end. The distal ends of each of the four second cleaning tendrils is anchored to the test mop strand bundle at the headband and at the tail band present on the test mop strand bundle. The second cleaning tendrils are composed of strips of non-woven polymeric loop material with each second cleaning tendril each having a width of one inch and a thickness of 0.25 inch.

A control mop strand bundle is employed that is composed of The yarn members that function as the plurality of first elongated cleaning tendrils configured as those in the test mop strand bundle that provide a control mop strand bundle having a 10-pound dry weight with first elongated cleaning tendrils having an average length of 18 inches as measured from headband edge to tendril edge. The control mop includes tailbands positioned at the same location as those in the test mop strand bundle.

The test mop strand bundle and the control mop strand bundle are each mounted to a mop head in the manner illustrated in FIG. 1 with the second elongated cleaning tendrils oriented in an outward facing orientation relative to the test mop strand bundle when mounted. The test mop strand bundle and the control mop strand bundle are each immersed in a solution containing tap water and floor cleaner solution present at a dilution of 12 ounces per gallon of water. Both the test mop strand bundle and the control mop strand bundle are then wrung to remove excess solution and applied to a test floor surface to be cleaned. The material employed is Global Industrial Floor Cleaner and Deodorizer as representative of suitable fool cleaner.

The test floor surface to be cleaned is a 12 square foot region of a commercial kitchen located proximate to the grill equipment. The test region is divided into two side-by-side areas; one for each mop strand bundle. Each mop strand bundle is applied to its respective test region and is passed over the associated test region in a figure eight pattern for a total of 12 passes.

Each mop strand bundle is then immersed in bucket containing 1 gallon of fresh water and is then wrung to a state where no additional liquid can be mechanically removed from the mop strand bundle allowing the liquid that is removed by wringing to collect in the associated bucket. The collected waste from each bucket is then transferred to an associated glass receptacle. The glass receptacles containing the collect water is then visually inspected and shows dirt and grime entrained therein as an opaque grey material. The water collected from the test mop strand bundle shows a color density at least three times greater than the water collected form the control bundle indicating that a greater amount of dirt and grime is removed from the floor surface cleaned by the test mop strand bundle.

The cleaned floor surfaces for both regions is visually inspected and shows greater dirt and grime removal from the region cleaned by the test mop strand bundle.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A mop strand bundle having a first side and an opposed second side, the mop strand bundle comprising:

a plurality of first elongated cleaning tendrils, each first elongated cleaning tendril having a first end, an opposed second end and a first elongated cleaning tendril width, the plurality of first elongated cleaning tendrils oriented in parallel abutting relationship to one another and connected to one another in at least one location, wherein said each first elongated cleaning tendril has a first surface roughness;

at least one second elongated cleaning tendril having a first end, a second end opposed to the first end and opposed elongated side surfaces, the at least one second elongated cleaning tendril oriented in parallel abutting and moveable relationship with the plurality of first elongated cleaning tendrils, wherein the at least one second elongated cleaning tendril has a second surface roughness, the second surface roughness greater than the first surface roughness;

a headband, the headband positioned in connected overlying fixed relationship to the plurality of elongated first elongated cleaning tendrils at a location between the first end and the second end of the plurality of elongated first cleaning tendrils and extending from the first side of the mop strand bundle to the second side of the mop strand bundle, wherein the first end of the at least one second elongated cleaning tendril is connected to the headband and wherein the at least one second elongated cleaning tendril extends perpendicularly outward from the headband and parallel to the first side and the second side of the mop strand bundle and contacts a portion of the plurality of first elongated cleaning tendrils, wherein the plurality of first elongated cleaning tendrils and the at least one second elongated cleaning tendril are moveable relative to one another; and at least one tailband, the at least one tailband positioned in overlying fixed relationship with the plurality of first elongated cleaning tendrils at a location distal to the headband, the at least one second elongated cleaning tendril is connected to the at least one tailband at a location proximate to the second end of the at least one second elongated cleaning tendril.

2. The mop strand bundle of claim 1 wherein the at least one second elongated cleaning tendril is located proximate to at least one of the first side of the mop strand bundle or the second side of the mop strand bundle.

3. The mop strand bundle of claim 1 wherein the at least one second elongated cleaning tendril comprises at least two second elongated cleaning tendrils in spaced relationship to one another, wherein the at least two second elongated cleaning tendrils are connected to the at least one tailband at locations distal to the headband.

4. The mop strand bundle of claim 1 wherein the plurality of first elongated cleaning tendrils are yarn members and wherein the yarn members are either cut yarn members, looped yarn members, or mixtures thereof.

5. The mop strand bundle of claim 4 wherein at least a portion of the yarn members contain microfibers.

6. The mop strand bundle of claim 1 wherein the plurality of first elongated cleaning tendrils are flat woven fiber strips, flat nonwoven fiber strip, flat woven fiber loops, or flat nonwoven fiber loops.

7. The mop strand bundle of claim 6 wherein at least a portion of the fiber strips or fiber loops contain microfibers.

8. The mop strand bundle of claim 1 wherein the at least one second elongated cleaning tendril includes woven mesh material and has a second elongated cleaning tendril width greater than the first elongated cleaning tendril width.

9. The mop strand bundle of claim 8 wherein the at least one second elongated cleaning tendril is a tubular member and comprises an inner member composed of foam.

10. The mop strand bundle of claim 1 wherein the headband is a woven mesh material having a headband roughness, wherein the headband roughness is equal to or greater than the second roughness of the at least one second elongated cleaning tendril.

11. The mop strand bundle of claim 10 wherein the headband is located midway between the first and second ends of the plurality of first elongated first cleaning tendrils.

12. A mop strand bundle having a first side and a second side opposed to the first side, the mop strand bundle comprising:

a plurality of first elongated cleaning tendrils, each first elongated cleaning tendrils having a first end and an opposed second end, the first elongated cleaning tendrils oriented in parallel relationship to one another, said each first elongated cleaning tendril having a first surface roughness;

at least two second elongated cleaning tendrils, the at least two second elongated cleaning tendrils each having a first end, a second end opposed to the first end and opposed elongated side surfaces, the at least two second elongated cleaning tendrils oriented in parallel relationship to at least one side edge of the mop strand bundle in abutting moveable relationship with at least one first elongated cleaning tendril of the plurality of first elongated cleaning tendrils, wherein the at least two second elongated cleaning tendrils each have a second surface roughness, the second surface roughness greater than the first surface roughness;

a headband, the headband positioned in connected overlying fixed relationship to the plurality of first elongated cleaning tendrils at a location between the first and second ends of the plurality of first elongated cleaning tendrils, and extending from the first side of the mop strand bundle to the second side of the mop strand bundle; and at least one tailband, the at least one tailband positioned in overlying fixed relationship with the plurality of first elongated cleaning tendrils at a location distal to the headband, wherein the first ends of the at least two second elongated cleaning tendrils are connected to the headband and wherein the at least two second elongated cleaning tendrils extend perpendicularly from the headband and parallel to the first side and the second side of the mop strand bundle and the second ends of the at least two second elongated cleaning tendrils are connected to the at least one tailband, and wherein the plurality of first elongated cleaning tendrils and the at least two second elongated cleaning tendrils are moveable relative to one another.

13. The mop strand bundle of claim 12 wherein the plurality of first elongated cleaning tendrils are yarn members and wherein the yarn members are either cut yarn members, looped yarn members, or mixtures thereof.

14. The mop strand bundle of claim 13 wherein at least a portion of the yarn members contain microfibers.

15. The mop strand bundle of claim 12 wherein the plurality of first elongated cleaning tendrils are flat woven fiber strips, flat nonwoven fiber strip, flat woven fiber loops, or flat nonwoven fiber loops.

16. The mop strand bundle of claim 15 wherein at least a portion of the fiber strips or fiber loops contain microfibers.

17. The mop strand bundle of claim 12 wherein the at least two second elongated cleaning tendrils are composed of a woven mesh material overlying a foam core.

18. The mop strand bundle of claim 17 wherein the at least two second elongated cleaning tendrils are in spaced relationship from one another.

19. The mop strand bundle of claim 18 wherein each respective second elongated cleaning tendril of the at least two second elongated cleaning tendrils is a tubular member.

20. The mop strand bundle of claim 12 wherein the headband is a woven mesh material having a headband roughness, wherein the headband roughness is equal to or greater than the second roughness.

21. The mop strand bundle of claim 12 wherein the headband is located midway between the first and second ends of the plurality of first elongated cleaning tendrils.

* * * * *